US006558889B1

(12) United States Patent
Oishi et al.

(10) Patent No.: US 6,558,889 B1
(45) Date of Patent: May 6, 2003

(54) SURFACE TREATMENT FOR ENHANCING HYDROPHOBICITY OF PHOTOGRAPHIC SUPPORT AND PHOTOTHERMOGRAPHIC MATERIAL BY USE THEREOF

(75) Inventors: Kiyoshi Oishi, Hino (JP); Kazuhiro Fukuda, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/229,126

(22) Filed: Aug. 27, 2002

Related U.S. Application Data

(62) Division of application No. 09/800,376, filed on Mar. 6, 2001, now Pat. No. 6,455,239.

(30) Foreign Application Priority Data

Mar. 10, 2000 (JP) ..... 2000/066778

(51) Int. Cl.[7] ..... G03C 1/76

(52) U.S. Cl. ..... 430/532; 430/531; 430/533; 430/536; 430/619; 216/24; 216/67; 428/409; 428/543

(58) Field of Search ..... 430/532, 533, 430/531, 536, 935, 619; 216/24, 67; 428/409, 543

(56) References Cited

U.S. PATENT DOCUMENTS 5,290,383 A * 3/1994 Koshimizu ..... 156/643
5,476,182 A * 12/1995 Ishizuka et al. ..... 216/68
5,874,013 A * 2/1999 Tokunaga et al. ..... 216/67
6,045,969 A * 4/2000 Verschueren et al. .... 430/270.1
6,455,239 B2 * 9/2002 Oishi et al. ..... 430/502

* cited by examiner

*Primary Examiner*—Thorl Chea
(74) *Attorney, Agent, or Firm*—Muserlian, Lucas and Mercanti

(57) ABSTRACT

A surface treatment method for enhancing hydrophobicity of the surface of a film support is disclosed, comprising subjecting at least one side of the surface to a gas-discharge plasma treatment in a gas phase atmosphere comprising (a) an inert gas comprising argon or helium and (b) a reactive gas comprising a hydrocarbon gas or fluorinated hydrocarbon gas. There is also disclosed a photothermographic material by the use of the support having been subjected to the surface treatment.

15 Claims, 1 Drawing Sheet

SURFACE TREATMENT FOR ENHANCING HYDROPHOBICITY OF PHOTOGRAPHIC SUPPORT AND PHOTOTHERMOGRAPHIC MATERIAL BY USE THEREOF

This Application is a Divisional Application of U.S. patent application Ser. No. 09/800,376 filed Mar. 6, 2001, now U.S. Pat. No. 6,455,239.

FIELD OF THE INVENTION

The present invention relates to a support for use in thermally developable silver halide photothermographic materials and thermally developable silver halide photothermographic materials using the same, and in particular to a surface treatment method suitable for silver halide photothermographic materials, support prepared by the method thereof and silver halide photothermographic materials having a support which has been subjected to a surface treatment, thereby exhibiting superior adhesion to the thermally developable silver halide light sensitive layer.

BACKGROUND OF THE INVENTION

There are known a variety of photosensitive materials having on a support a light sensitive layer, forming images upon imagewise exposure to light. Of these, techniques of thermally developable silver halide photographic materials, i.e., photothermographic materials are cited as a system suited for environmental protection and a simple image forming means.

Silver halide photothermographic materials are detailed in U.S. Pat. Nos. 3,152,904 and 3,487,075; Morgan "Dry Silver Photographic Material" and D. H. Klosterboer, "Thermally Processed Silver Systems" (Imaging Processes and Materials, Neblette, 8th Edition, edited by J. M. Sturge, V. Walworth, and A. Shepp, page 279, 1989), etc.

Such a photothermographic material forms images, after exposure, through thermal development, which usually comprises a reducible silver source (e.g., organic silver salt), a catalytically active amount of photocatalyst (e.g., silver halide), a reducing agent and optionally an image toning agent for modifying image color, which are dispersed in an organic binder matrix. The photothermographic materials are stable at ordinary temperature and forms silver upon heating, after exposure, at a relatively high temperature (e.g., 80 to 150° C.) through an oxidation-reduction reaction between the reducible silver source (which functions as an oxidizing agent) and the reducing agent. The oxidation-reduction reaction is accelerated by catalytic action of a latent image produced by exposure. Silver formed through reaction of the reducible silver salt in exposed areas provides a black image, which contrasts with non-exposed areas, leading to image formation. This reaction process proceeds without supplying a processing solution such as water. Such silver halide photothermographic materials are consistent with the recently increasing requirement for simplified processing and environmental protection.

In almost silver halide photothermographic materials, organic solvent-based coating solutions are usually coated and dried to form a light sensitive layer. For example, the use of an organic solvent-based coating solution comprised of toluene and a methyl ethyl ketone solution of polyvinyl butyral is described in U.S. Pat. No. 5,415,993. Further, coating solutions containing 2-butanol or methanol as an organic solvent are employed to form a light sensitive layer. Organic solvent-based coating solutions have to be coated so that a photothermographic light sensitive layer cannot be formed on the support subbed for use in conventional silver halide photographic materials. Thus, a photothermographic silver salt light sensitive layer is directly coated on a support having no sublayer.

In such a case, however, it was proved that there are problems with respect to adhesion between the support and the photothermographic light sensitive layer. In conventional tape-pull tests, it was judged that sufficient adhesion was achieved. However, it was further found that delamination was caused when a roll film having a photothermographic light sensitive layer and a backing layer is cut to a given size using a cutting machine such as a trimmer or a guillotine cutter.

In view of the foregoing problems, one aspect of the present invention concerns a photothermographic material exhibiting superior adhesion property and causing no delamination when being cut with a cutting machine.

SUMMARY OF THE INVENTION

It is an object of the present invention to provide a treatment method of a support, thereby leading to prevention of delamination between the support and the photothermographic light sensitive layer, the support and the photothermographic material.

The object of the invention can be accomplished by the following constitution:

(1) a surface treatment method for enhancing hydrophobicity of the surface of a film support, the method comprising subjecting at least one side of the support surface to a plasma discharge treatment in a gas phase atmosphere introduced under atmospheric pressure or pressure proximal, which comprises an inert gas containing argon or helium and a reactive gas containing a hydrocarbon gas or fluorinated hydrocarbon gas, while the support being continuously transported;

(2) the surface treatment method described in (1), wherein the inert gas contains argon of not less than 50% by pressure and further containing helium of less 40% by pressure;

(3) the surface treatment method described in (1) or (2), wherein the plasma discharge treatment is conducted in a gas phase containing not more than 750 ppm of oxygen;

(4) the surface treatment method described in (3), wherein oxygen is not more than 600 ppm;

(5) the surface treatment method described in (4), wherein oxygen is not more than 200 ppm;

(6) a support having thereon a layer formed by coating a organic solvent-based solution, wherein at least one surface of the support has been subjected to a plasma discharge treatment under atmospheric pressure or pressure proximal thereto in a gas phase comprising an inert gas containing argon or helium and a reactive gas containing a hydrocarbon gas or fluorinated hydrocarbon gas, while the support being continuously transported;

(7) the support described in (6), wherein the support surface which has been subjected to the plasma discharge treatment exhibits a larger contact angle between the support and methylene chloride than a support which has not been subjected to the treatment;

(8) the support described in (6), wherein the support surface which has been subjected to the plasma discharge treatment exhibits a larger contact angle between the support and water than a support which has not been subjected to the treatment;

(9) a silver halide photothermographic material comprising a support having a light sensitive layer at least one side of the support, which has been subjected to a plasma discharge treatment in a gas phase atmosphere introduced under atmospheric pressure or pressure proximal, which comprises an inert gas containing argon or helium and a reactive gas containing a hydrocarbon gas or fluorinated hydrocarbon gas.

DETAILED DESCRIPTION OF THE INVENTION

Figure 1:
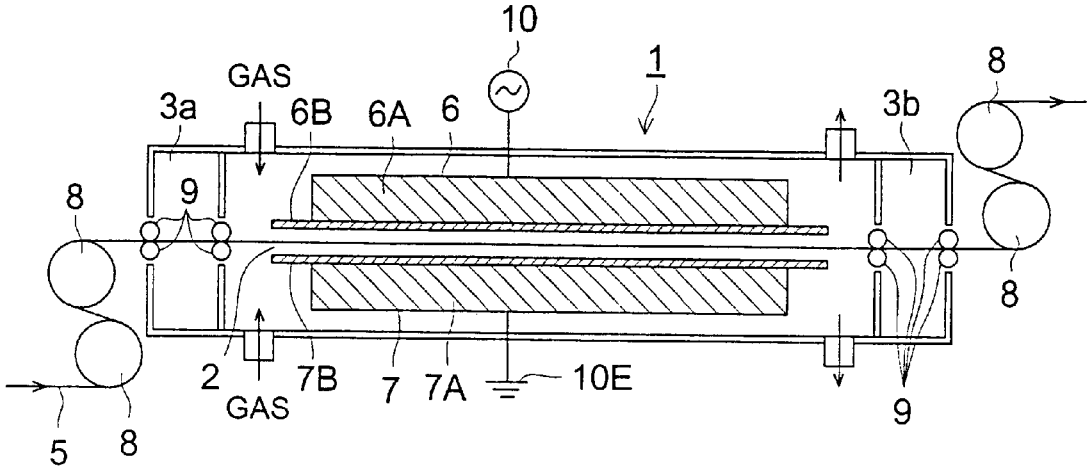
FIG. 1 is a schematic illustration of a surface treatment apparatus, which is an example of the apparatus used for performing the treatment of this invention.

In the invention, a film support is subjected to a plasma discharge treatment in a gaseous atmosphere, which is also referred to as a gas-discharge plasma treatment and the gaseous atmosphere comprising an inert gas containing argon (Ar) of 50% by pressure. The content of argon is preferably not less than 60% by pressure to achieve efficient modification. Other inert gas may be contained, including, for example, neon (Ne), helium (He), Krypton (Kr), and xenon (Xe). The content of the gas other than argon is preferably less than 50% by pressure, and more preferably less than 40%.

Effects of the gas-discharge plasma treatment according to this invention is contemplated as follows. Argon gas, as a mono-atomic gas has a larger atomic weight and a larger atomic volume relative to helium gas so that during the treatment, argon is struck to the surface of a plastic resin support to cause etching to protrude the surface. Argon gas results in such a effect which is not observed in helium gas. Moreover, argon gas is relatively low-priced, achieving marked modification effects, as compared to other inert gases. Krypton gas or xenon gas, for example, needs higher output and higher frequency to generate a plasma state, leading to a too hard treatment, causing damages on the surface of the support.

In this invention, not less than 50% by pressure of the introduced inert gas is accounted for by argon and less than 50% by pressure of the introduced inert gas may be other inert gas. Other inert gases include the above-mentioned inert gas, of which helium gas is preferred. Thus, it is preferred that less than 40% by pressure of the inert gas is helium gas.

In the gas-discharge plasma treatment of the invention, reactive gas of a hydrocarbon and/or fluorinated hydrocarbon gas is employed together with the inert gas. The ratio of the reactive gas to the inert gas is preferably 0.01 to 0.30% by weight, and more preferably 0.02 to 0.2% by pressure. Hydrocarbons usable in this invention include a saturated hydrocarbon represented by general formula, $C_nH_{2n+2}$ (in which n is an integer of 1 to 12) and an unsaturated hydrocarbon represented by general formula, $C_nH_{2n}$ or $C_nH_{2n-2}$ (in which n is an integer of 1 to 12). Examples of the saturated hydrocarbon represented by formula $C_nH_{2n+2}$ include methane, ethane, propane, butane, pentane, hexane, heptane, octane, nonane and decane. Examples of the unsaturated-hydrocarbon gas represented by formula $C_nH_{2n}$ include ethylene, propene, butene, pentene, and hexane. Examples of the unsaturated hydrocarbon gas represented by formula $C_nH_{2n-2}$ include not only acetylene, propyne, butyne, and pentyne, but also butadiene, pentadiene, and hexadiene. Hydrocarbons having 4 or more carbon atoms can be treated in a gas form by elevating the treatment temperature. Examples of fluorinated hydrocarbon gas include $CH_3F$ gas, $C_2H_5F$ gas, $C_3H_7F$ gas, $C_4H_9F$ gas, $C_5H_{11}F$ gas and $C_6H_{13}F$ gas. Of these, hydrocarbon gas is preferred. A hydrocarbon gas may be mixed with a fluorinated hydrocarbon gas.

Next, there will be described the gas-discharge plasm treatment used in this invention, which is carried out in an atmosphere comprising (a) an inert gas including not less than 50% by pressure of the inert gas and (b) reactive gas comprised of hydrocarbon gas and/or fluorinated hydrocarbon gas. The treatment can be conducted in accordance with the manner described in JP-A 2000-72903 (hereinafter, the term, JP-A means an unexamined, published Japanese Patent Application).

FIG. 1 illustrates a surface treatment apparatus, which is an example of the apparatus used for performing the treatment of this invention but embodiments of this invention is by no means limited to this.

An inert gas including at least 50% by pressure of argon and a reactive gas are mixed and introduced through an inlet into a treating chamber (2) under atmospheric pressure or in the vicinity thereof to allow the gas mixture to be filled within the treatment chamber to form a treatment gas between paired electrodes (6, 7). A film support (5) is subjected to the plasma discharge treatment in such a gas atmosphere, while being transporting between the electrodes. In this case, to prevent a lowering of efficiency of the treatment due to air carried-in by the transporting support, it needs to intercept the air, so that the surface treatment apparatus (1) according to this invention is provided with the surface-treatment chamber (2), a preliminary chamber (3*a*) adjacent to the treatment chamber (2) located at the upstream end in the transporting direction of the support (5) and optionally, a preliminary chamber (3*b*) adjacent to the treatment chamber (2) located at the downstream end in the transporting direction of the support (5). Introducing at least one component gas into the preliminary chamber (3*a* or 3*b*) through an undesignated inlet, the preliminary chamber (3*a*) is filled with the gas, which intercepts air carried-in along with the transporting support (5). The gas introduced into the preliminary chamber (3*a*) preferably has the same composition as in the treatment chamber (2) to achieve a stable plasma discharge treatment. Gas may be introduced into the preliminary chamber from the treatment chamber through an opening. Of the preliminary chambers (3*a*, 3*b*), the preliminary chamber 3*a* on the upstream end is effective to achieve intercepting of carried-in air. Accordingly, preliminary chamber 3*b* on the downstream end may optionally be provided. A partitioning means such as nip rollers (9) is provided between the preliminary chamber (3*a* or 3*b*) and the outside or the treatment chamber (2). The support is continuously transported between paired electrodes (6, 7) in the treatment chamber (2) by the partitioning means (9) or an undesignated transporting means. The paired electrodes (6, 7) are each a planar electrode, which is comprised of an electrode member (6A, 7A) of conductive metal (e.g., stainless steel, aluminum, copper) and dielectrics covering at least a portion of the electrode member (6A, 7A), such as rubber, glass, or ceramics. In FIG. 1, planar electrodes such as paired electrodes (6, 7) are employed, but one of them or both may be a cylindrical electrode or roll-form electrode. Of the paired electrode (6, 7), electrode (6) is connected to a high frequency electrical source and the other electrode (7) is grounded (10E) to cause discharging between the paired electrodes (6, 7). There is also provided a guide roller (8) to allow the support to be transported to surface treatment apparatus (1) or to be transported from the surface treatment apparatus.

In this invention, it is preferred to mix the inert gas with the reactive gas prior to introduction of the treatment gas into the treatment chamber. Alternatively, gases may be independently introduced if a homogeneous atmosphere is formed between the paired electrodes (6, 7).

The discharging state caused in the discharge-in-gas plasma treatment used in this invention is similar to that caused glow discharge under vacuum but the discharging state of the plasma discharge treatment in gas, suitable under atmospheric pressure or a pressure in the vicinity thereof is achieved by intercepting air carried-in by the support.

The discharge-intensity in the gas-discharge plasma treatment used in this invention is preferably not less than 50 $W \cdot min/m^2$ but less than 500 $W \cdot min/m^2$ to perform stable treatment without causing arc discharge. Performing the plasma discharge treatment in gas within this range leads to a homogeneous finishing without causing damage, resulting in superior adhesion property.

Performing the gas-discharge plasma treatment in the pulsed electric field achieves effective enhancement of hydrophobicity. Thus, the treatment of plasma discharge in the pulsed electric field is a preferable method.

In cases when a pre-heated support is subjected to the gas phase plasma discharge treatment, adhesion of the layer to be adhered (such as a photothermographic light sensitive layer or a backing layer) can be enhanced by the treatment for a short duration, thereby markedly reducing damages such as yellowing, fracturing or cracking of the support or abrasion on the outermost surface. The preheating temperature is preferably within the range of ±35% of the glass transition temperature of the support, and more preferably ±20%. Interception of the air carried-in along with the transporting support by the use of the foregoing method and surface treatment apparatus results in markedly reduced oxygen concentration in the treatment chamber. To conduct the effective running of the surface treatment on the support surface, the oxygen concentration in the treatment chamber is preferably not more than 1000 ppm, more preferably not more than 750 ppm, still more preferably not more than 600 ppm, and optimally not more than 200 ppm.

Supports relating to this invention may be further subjected to a surface treatment for enhancing hydrophobicity other than the gas-discharge plasma treatment according to this invention. Such treatments include, for example, a plasma treatment and a flame treatment.

Examples of the supports used in this invention include a polyester film support, polycarbonate film support, polyimide film support, polystyrene (syndiotactic) film support, polyolefin film support, polyolefin resin-coated print paper support and polyester resin-coated print paper support. The polyolefin resin-coated print paper support, polyester resin-coated print paper support, polyester film support and polyolefin film support may be contained with a white pigment. Such supports are used for print paper so that the support surface exhibits white to look as a reflection image. Examples of preferred white pigments include barium sulfate, titanium oxide, magnesium carbonate, and zinc oxide. Of these, titanium oxide is specifically preferred. Titanium oxide include an anatase tyoe and a rutile type, and the anatase type is preferable in terms of stability in whiteness.

Polyolefins used in the polyolefin support and polyolefin resin-coated support include high density polyethylene, intermediate density polyethylene, low density polyethylene and polypropylene.

A polyester film support is preferred as a support used in this invention. The polyester film support which is mainly comprised of polyester exhibits superior mechanical strength and dimensional stability, compared to other resin film supports and is broadly employed as a support for silver halide photographic materials or other materials. Polyester constituting the polyester film support may be a polymer which is co-polymerized with another polymerizing component, or may be blended with other polyesters or a polymer other than a polyester. The polyester film support used in this invention is a support which is obtained by a bi-axially orientation casting method, in which a polyester obtained by esterification or polycondensation of dicarboxylic acid and diol constituents is melted to form a sheet and subjected to biaxial stretching. Of the constituents, a preferred dicarboxylic acid is terephthalic acid or 2,6-naphthalene-dicarboxylic acid in terms of transparency, mechanical strength and dimensional stability. A preferred diol is ethylene glycol or 1,4-cyclohexane dimethanol in terms of the foregoing. Polyesters obtained by esterification or polycondensation of such dicarboxylic acids and diols are preferred. Examples of specifically preferred polyesters include polyethyelene terephthalate (hereinafter, also referred to as PET), polyethylene naphthalate, specifically, polyethylene 2,6-naphthalate (hereinafter, also referred to as PEN), copolyester of ethylene terephthalate/2,6-naphthalate, comprised of terephthalic acid, 2,6-naphthalen-dicarboxylic acid and ethylene glycol, copolyester obtained by melting ester exchange of PET and, PEN, copolyester of ethylene terephthalate, cyclohexane dimethanol and ethylene glycol, copolymer of ethylene-2,6-naphthalate, cyclohexane dimethanol and ethylene glycol, and a mixed polyester comprising diols of ethylene glycol and cyclohexane dimethanol and dicarboxylic acids of terephthalic acid and 2,6-naphthalene-dicarboxylic acid. Of these polyesters, when the content of an ethylene terephthalate unit and/or an ethylene 2,6-naphthalate unit is more than 70% by weight, based on total ester, copolyester films which are superior in transparency, mechanical strength and dimensional stability are obtained.

It is preferred that the support used in this invention exhibits a glass transition point of 70 to 200° C., a transparency at 500 nm of not less than 60%, a thickness of not less than 50 $\mu$m (more preferably 60 to 200 $\mu$m) and a Young modulus of not less than 1.5 GPa.

The surface of the support which has been subjected to the gas-discharge plasma treatment exhibits enhanced hydrophobicity, compared to a non-treated support. The level of hydrophobicity can be confirmed by measuring a contact angle with respect to methylene iodide and a contact angle with respect to water. The contact angle with respect to methylene iodide (i.e., contact angle between the support and methylene iodide) indicates the extent of a non-polar component on the surface of a support and the larger contact angle indicates the more non-polar component. The contact angle with respect to water (i.e., contact angle between the support and water) indicates the extent of a hydrogen bond component on the surface of a support, and the larger contact angle indicates lowering of the hydrogen bond component. Further, the level of a polar component of a support can be known by measuring the contact angle with respect to nitromethane. Polyethylene terephthalate supports usually exhibit 20° or less of a contact angle with respect to methylene iodide as a measure of a non-polar component and 60 to 65° of a contact angle with respect to water as a measure of a hydrogen bond component. The contact angle of a non-treated support with respect to methylene iodide or water can be increased by the treatment of this invention. The contact angle with respect to methylene iodide is preferably not less than 20°, and more preferably not less than 30°; and the contact angle with respect to water is preferably not less than 65°, and more preferably not less than 70°.

The non-polar component and hydrogen bond component on the surface can be represented by the following formulas:

$$\gamma^d = \left\{\frac{\gamma_1 \times (\cos\theta_1 + 1)}{2}\right\}^2 \times \frac{1}{\gamma_1}$$

$$\gamma^h = \left\{\frac{\gamma_2 \times (\cos\theta_2 + 1) - 2\sqrt{\gamma^d \times \gamma_2^d}}{2}\right\}^2 \times \frac{1}{\gamma_2^h}$$

Herein, $\gamma^d$: non-polar component of surface energy of support $\gamma^h$: a hydrogen bond component of surface energy of support $\gamma_1$: surface energy of methylene iodide, 51 mN/m (20° C.)

$\gamma_2$: surface energy of water, 51 mN/m (20° C.)

$\gamma^d_2$: non-polar component of surface energy of water $\gamma^h_2$: a hydrogen bond component of surface energy of water $\theta_1$: contact angle between methylene iodide and support $\theta_2$: contact angle between water and support The surface energy obtained according to the foregoing formulas, after being subjected to the treatment for enhancing hydrophobicity is preferably decreased by 2 nN/m or more with respect to the non-polar component and hydrogen bond component of surface energy of the support.

As another measure of effectiveness of the treatment for enhancing hydrophobicity, a peak of TOF-SIMS (Time of Flight-Secondary Ion Mass Spectrum) of the support surface is preferably decreased by 20% or more. Further, as another measure, the proportion of atoms present on the surface is measured by ESCA and it is preferred to allow the proportion to decrease by 1% or more.

The support which has been subjected to the gas-discharge plasma treatment for enhancing hydrophobicity exhibits superior adhesion to a silver halide light sensitive layer or a backing layer of the photothermographic material, and delamination of the light sensitive layer does not occur even when instantaneously strong shearing force is applied thereto.

Next, photothermographic silver halide materials will be described. One feature of the silver halide photothermographic material relating to the invention is that the photothermographic material isothermally developed at a temperature of 80 to 150° C. to form images and is not further subjected to fixing. Therefore, silver halide and a silver salt in unexposed areas remain in the photothermographic image forming layer and unless heated, no increase of the fog density takes place. The transmittance of the thermally developed photothermographic material is preferably not more than 0.2, and more preferably 0.02 to 0.2 in terms of transmission density.

Silver halide grains contained in the photothermographic image forming layer function as a light sensor. In order to minimize cloudiness after image formation and to obtain excellent image quality, the less the average grain size, the more preferred, and the average grain size is preferably less than 0.1 μm, more preferably between 0.01 and 0.1 μm, and still more preferably between 0.02 and 0.08 μm. The average grain size as described herein is defined as an average edge length of silver halide grains, in cases where they are so-called regular crystals in the form of cube or octahedron. Furthermore, in cases where grains are not regular crystals, for example, spherical, cylindrical, and tabular grains, the grain size refers to the diameter of a sphere having the same volume as the silver grain. Furthermore, silver halide grains are preferably monodisperse grains. The monodisperse grains as described herein refer to grains having a monodispersibility obtained by the formula described below of less than 30%, and more preferably from 0.1 to 20%:

Monodispersibility=(standard deviation of grain diameter)/(average grain diameter)×100(%).

The silver halide grain shape is not specifically limited, but a high ratio accounted for by a Miller index [100] plane is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized. Furthermore, another preferred silver halide shape is a tabular grain. The tabular grain as described herein is a grain having an aspect ratio (AR), as defined below, of at least 3:

AR=average grain diameter (μm)/grain thickness (μm)

Of these, the aspect ratio is preferably between 3 and 50. The grain diameter is preferably not more than 0.1 μm, and is more preferably between 0.01 and 0.08 μm. These are described in U.S. Pat. Nos. 5,264,337, 5,314,789, 5,320,958, and others. In the present invention, when these tabular grains are used, image sharpness is further improved. The composition of silver halide may be any of silver chloride, silver chlorobromide, silver iodochlorobromide, silver bromide, silver iodobromide, or silver iodide.

The halide composition of silver halide grains is not specifically limited and may be any one of silver chloride, silver chlorobromide, silver iodochlorobromide, silver bromide, silver iodobromide and silver iodide. Silver halide emulsions used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Silver halide may be incorporated into the image forming layer by any means so that the silver halide is arranged so as to be close to reducible silver source. The silver halide may be formed by reaction of an organic silver salt and a halide ion to convert a part of the organic silver salt to silver halide. Alternatively, silver halide which has been prepared in advance may be added to a solution to prepare an organic silver salt. A combination of these may be applicable bur the latter is preferred. The content of silver halide is preferably 0.75 to 30% by weight, based on an organic silver salt.

Silver halide preferably occludes ions of metals belonging to Groups 6 to 11 of the Periodic Table. Preferred as the metals are W; Fe, Co, Ni, Cu, Ru, Rh, Pd, Re, Os, Ir, Pt and Au.

Silver halide grains used in the photothermographic materials relating to the invention are preferably be subjected to chemical sensitization. As is commonly known in the art, the chemical sensitization includes, for example, sulfur sensitization, selenium sensitization, tellurium sensitization. There are also applicable in the invention noble metal sensitization with gold compounds or platinum, palladium or iridium compounds, or reduction sensitization.

Organic silver salts are one of important materials used in the silver halide photothermographic material. Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963. Preferred organic silver salts include silver behenate, silver arachidate and silver stearate.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed. For example, to an organic acid is added an alkali metal hydroxide (e.g., sodium hydroxide, potassium hydroxide, etc.) to form an alkali metal salt soap of the organic acid (e.g., sodium behenate, sodium arachidate, etc.), thereafter, the soap and silver nitrate are mixed by the controlled double jet method to form organic silver salt crystals. In this case, silver halide grains may be concurrently present.

In the present invention, organic silver salts have an average grain diameter of 1 $\mu$m or less and are monodisperse. The average diameter of the organic silver salt as described herein is, when the grain of the organic salt is, for example, a spherical, cylindrical, or tabular grain, a diameter of the sphere having the same volume as each of these grains. The average grain diameter is preferably between 0.01 and 0.8 $\mu$m, and more preferably between 0.05 and 0.5 $\mu$m. Furthermore, the monodisperse as described herein is the same as silver halide grains and preferred monodispersibility is between 1 and 30%. It is also preferred that at least 60% of the total of the organic silver salt is accounted for by tabular grains. The tabular grains refer to grains having a ratio of an average grain diameter to grain thickness, i.e., aspect ratio of 3 or more. To obtain such tabular organic silver salts, organic silver salt crystals are pulverized together with a binder or surfactant, using a ball mill. Thus, using these tabular grains, photosensitive materials exhibiting high density and superior image fastness are obtained.

To prevent hazing of the photothermographic material, the total amount of silver halide and organic silver salt is preferably 0.5 to 2.2 g in equivalent converted to silver per $m^2$, thereby leading to high contrast images. The amount of silver halide is preferably not more than 50%, more preferably not more than 25%, and still more preferably 0.1 to 15% by weight, based on total silver content.

Reducing agents are preferably incorporated into the thermally developable photothermographic material of the present invention. Examples of suitable reducing agents are described in U.S. Pat. Nos. 3,770,448, 3,773,512, and 3,593,863, and Research Disclosure Items 17029 and 29963. Of these reducing agents, particularly preferred reducing agents are hindered phenols. The hindered phenol preferably is a compound represented by the general formula:

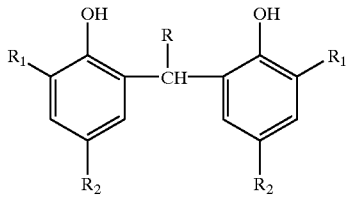

wherein R represents a hydrogen atom or an alkyl group having from 1 to 10 carbon atoms (e.g., —$C_4H_9$, 2,4,4-trimethylpentyl), and $R_1$ and $R_2$ each represents an alkyl group having from 1 to 5 carbons atoms (e.g., methyl, ethyl, t-butyl).

Exemplary examples of the compounds represented by the formula (A) are shown below.

A-1

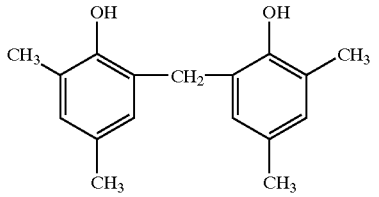

A-2

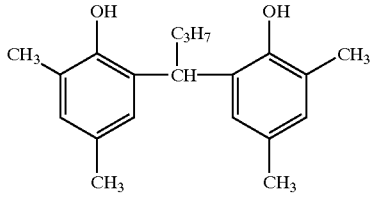

A-3

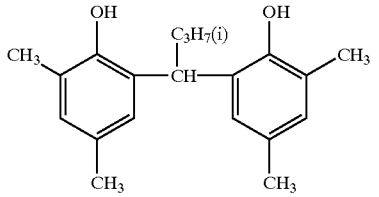

A-4

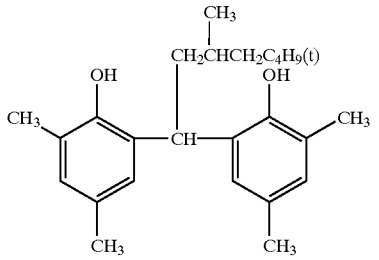

A-5

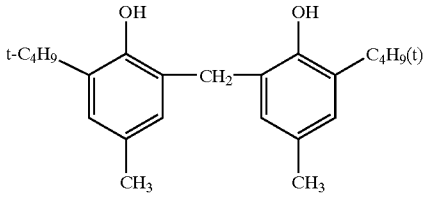

-continued

A-6

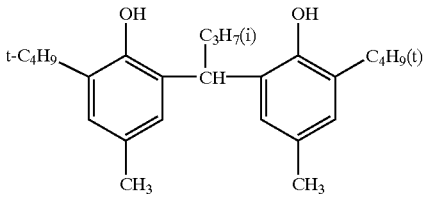

A-7

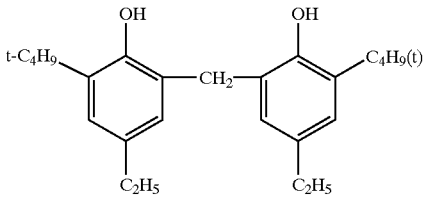

The used amount of reducing agents represented by the above-mentioned general formula (A) is preferably between $1\times10^{-2}$ and 10 moles, and is more preferably between $1\times10^{-2}$ and 1.5 moles per mole of silver.

Binders suitable for the thermally developable photothermographic material are transparent or translucent, and generally colorless hydrophobic polymeric compounds (or hydrophobic resin compounds). Examples thereof include natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly (vinylpyrrolidone), casein, starch, poly(acrylic acid), poly (methylmethacrylic acid), poly(vinyl chloride), poly (methacrylic acid), co(styrene-maleic acid anhydride) polymer, co(styrene-acrylonitrile)polymer, co(styrene-butadiene)polymer, poly(vinyl acetal) series (for example, poly(vinyl formal)and poly(vinyl butyral), poly(ester) series, poly(urethane) series, phenoxy resins, poly (vinylidene chloride), poly(epoxide) series, poly(carbonate) series, poly(vinyl acetate) series, cellulose esters, poly (amide) series. In this invention, polyvinyl formal, polyvinyl acetal, cellulose triacetate, and cellulose tributylate are preferred and polyvinyl butyral is specifically preferred.

A non-photosensitive layer may be provided on the outer side of the photothermographic image forming layer to protect the surface of photothermographic materials or prevent the surface from abrasion marks. Binder used in the non-photosensitive layer may be the same or different from that used in the photosensitive layer. Polymeric compounds used as a binder preferably have a weight-average molecular weight of 30,000 or more, and more preferably 50,000 or more. In the present invention, the amount of the binder in the light sensitive layer is preferably between 1.5 and 6 $g/m^2$, and is more preferably between 1.7 and 5 $g/m^2$. Suitable contents of image forming materials can maintain the image density.

To enhance adhesion of the light sensitive layer or the backing layer to the hydrophobicity-enhanced surface of the support, it is preferred to allow a polymeric compound having a weight-average molecular weight of less than 30,000, more preferably not more than 15,000 and still more preferably less than 10,000 to be contained in the light sensitive layer or backing layer as a binder. The content of such a low molecular weight polymeric compound is preferably not more than 30% by weight, based on the total binder, and more preferably 10 to 30% by weight.

In the present invention, a matting agent is preferably incorporated into the image forming layer side. In order to minimize the image abrasion after thermal development, the matting agent is provided on the surface of the photothermographic image forming layer and the matting agent is preferably incorporated in an amount of 0.5 to 30 percent in weight ratio with respect to the total binder in the emulsion layer side. Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169. The shape of the matting agent may be crystalline or amorphous. However, a crystalline and spherical shape is preferably employed. The size of a matting agent is expressed in the diameter of a sphere which has the same volume as the matting agent. The particle diameter of the matting agent in the present invention is referred to the diameter of a spherical converted volume. The matting agent employed in the invention preferably has an average particle diameter of 0.5 to 10 $\mu$m, and more preferably of 1.0 to 8.0 $\mu$m.

The silver halide photothermographic materials relating to the invention have at least an image forming layer on the support. There may be provided the image forming layer alone, but further thereon, at least a light-insensitive layer is preferably provided. To control the amount or wavelength distribution of light transmitting through the image forming layer, a filter layer may be provided on the same side or opposite side to the image forming layer. Further, the image forming layer may contain a dye or pigment. There are usable compounds described in JP-A 59-6481 and 59-182436; U.S. Pat. Nos. 4,271,263, and 4,594,312; European Patent 533,008 and 652,473; and JP-A 2-216140, 4-348339, 7-191432 and 7-301890.

Further, the non-photosensitive layer is preferably added with the binder or matting agent described above, and may be added with a lubricant such as polysiloxane compounds, wax, or liquid paraffin. The photothermographic image forming layer may be comprised of plural layers, or high-speed and low-speed layers to adjust gradation.

Image toning agents are preferably incorporated into the thermally developable photosensitive material used in the present invention. Examples of preferred image toning agents are disclosed in Research Disclosure Item 17029.

Mercapto compounds, disulfide compounds and thione compounds may be incorporated to retard or promote thermal development, or to enhance spectral sensitization efficiency or improve image lasting quality.

Antifoggants may be incorporated into the thermally developable photosensitive material to which the present invention is applied, as disclosed in U.S. Pat. Nos. 4,546,075 and 4,452,885, and Japanese Patent Publication Open to Public Inspection No. 59-57234. Particularly preferred mercury-free antifoggants are heterocyclic compounds having at least one substituent, represented by —C(X1)(X2)(X3) (wherein X1 and X2 each represent halogen, and X3 represents hydrogen or halogen), as disclosed in U.S. Pat.

Nos. 3,874,946 and 4,756,999. As examples of suitable antifoggants, employed preferably are compounds described in paragraph numbers [0062] and [0063] of JP-A No. 9-90550. Furthermore, other suitable antifoggants are disclosed in U.S. Pat. No. 5,028,523, and British Patent Application Nos. 92221383. No. 4, 9300147. No. 7, and 9311790. No. 1.

In silver halide photothermographic materials relating to the invention are used sensitizing dyes described in JP-A 63-159841, 60-140335, 63-231437, 63-259651, 63-304242, and 63-15245; U.S. Pat. Nos. 4,639,414, 4,740,455, 4,741,966, 4,751,175 and 4,835,096. Sensitizing dyes usable in the invention are described in Research Disclosure Item 17643, Sect. IV-A (December, 1978 page 23), ibid, Item 1831 Sect. X (August, 1978, page 437) and cited literatures. There can be advantageously sensitizing dyes having spectral sensitivity suited for spectral characteristics of various scanner light sources. For example, compound described in JP-A 9-34078, 9-54409 and 9-80679 are preferred.

It is preferred to incorporate a surfactant into a coating solution of the silver halide light sensitive elayer, protective layer or backing layer so that when coated on the support, uniform coating is achieved without causing troubles in coating. Surfactants usable in this invention are not specifically limited but fluorinated surfactants are preferable in light of coating on the hydrophobicity-enhanced surface. The fluorinated surfactants usable in this invention include cationic, anionic, nonionic and amphoteric surfactants. Preferred fluorinated surfactants are compounds comprising a entirely or partially fluorinated hydrocarbon chain having 2 to 20 carbon atoms and a hydrophilic group, such as an anionic group of a metal salt, an anionic group of a quaternary ammonium salt, a polyalkyleneoxide group, betaine and a quaternary ammonium cation. Examples of the fluorinated surfactants include those which are described in British Patent No. 1,330,356 and 1,542,631; U.S. Pat. No. 3,666,478, and 3,888,678; JP-B No. 52-26687 (hereinafter, the term, JP-B means a published Japanese Patent) and JP-A No. 48-43130, 49-46733, 51-32322, 2-12145 and 3-24657; and JP-B No. 3-27099. Exemplary examples of fluorinated surfactants useful in this invention are shown below but are by no means limited to these.

F-1

$C_8F_{17}SO_3K$

F-2

$C_8F_{17}SO_3N(C_2H_5)_4$

F-3

$C_7F_{15}COONa$

F-4

$C_8F_{17}CH_2CH_2OSO_3Na$

F-5

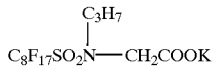

F-6

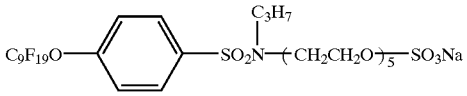

F-7

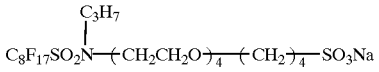

F-8

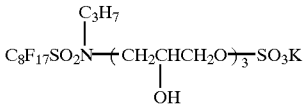

-continued

F-9

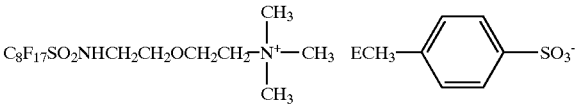

F-10

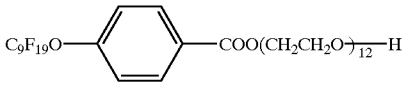

F-11

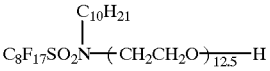

F-12

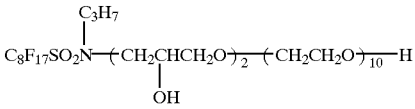

F-13

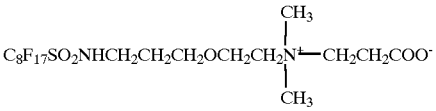

F-14

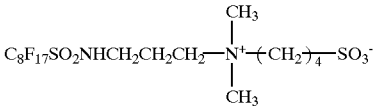

F-15

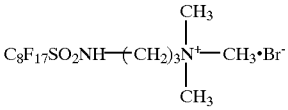

F-16

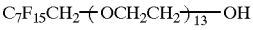

F-17

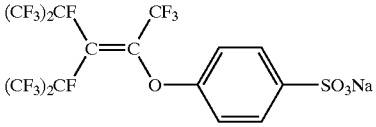

F-18

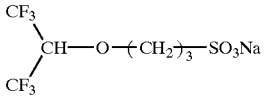

F-19

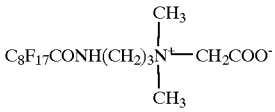

F-20

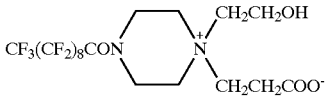

The content of the fluorinated surfactant is preferably 0.5 to 100 mg per $m^2$ of a photothermographic material, and more preferably 1 to 50 mg.

In the backing layer of the photothermographic material used in this invention, water-soluble and organic solvent-soluble binder can be employed, and the organic solvent-soluble binder is preferred so as to match the light sensitive layer. Adhesion of the organic solvent-soluble binder can also be satisfactorily achieved by subjecting the support to the surface treatment of this invention. Examples of the organic solvent-soluble binder are the same as those used in the light sensitive layer. The backing layer may be comprised of a single layer or plural layers. The backing layer can be provided with various functions such as antistatic, anti-abrasion, anti-halation and curl-balance.

In general, curl balance is controlled by the physical properties of the binder material, the layer thickness and the content of materials which are coated on both sides of the silver halide photothermographic material so that the balance can be achieved by the optimal combination thereof.

To endow antistatic capability to the silver halide photothermographic material, it is preferable to provide a layer containing an antistatic agent on the support. Various electrically conductive antistatic agents are employed in the photographic art and antistatic agents which exhibit high conductivity even after being subjected to thermal development are specifically useful. Such conductive antistatic agents include, for example, fine metal oxide particles and conductive polymers, which are incorporated into at least one constituent layer on the support, and preferably on a backing layer. Conductive antistatic agents or conductive antistatic compositions which are employed in conventional silver halide photographic materials are also applicable to photothermographic materials relating to this invention.

Any compound having an absorption within the desired wavelength region may be employed as an anti-halation dye and examples of preferred compounds include those described in JP-A No. 59-6481 and 59-182436; U.S. Pat. Nos. 4,271,263 and 4,594,312; European Patent No. 533,008 and 652,473; JP-A No. 2-216140, 4-348339, 7-191432 and 7-301890.

Coating methods of a light sensitive layer, a backing layer and a protective layer include, for example, an extrusion coating, extrusion coating under reduced pressure and slide coating. Of these, the extrusion coating method is more preferred.

The light sensitive layer or backing layer may not be coated via a sublayer but may be directly coated on the support having the hydrophobicity-enhanced surface of this invention. One advantageous aspect relating to silver halide photothermographic materials of this invention is that immediately after being subjected to the hydrophobicity-enhancing surface treatment, without being taken-up on a roll, the support can be continuously coated with a light sensitive layer or a backing layer. The silver halide photothermographic materials of this invention can be manufactured at substantially the same cost as in cases where being directly coated on the non-treated support. Further, photothermographic materials exhibiting superior adhesion can be stably manufactured. The support which has been subjected to the gas-discharge plasma treatment for enhancing hydrophobicity may be temporarily reeled. In such a case, the support surface does not adhere with each other while being reeled, as caused in a support which has been subjected to a similar treatment for enhancing hydrophilicity.

From a conventional peeling test in which the surface is cut deeply at an angle of 45°, a cellophane adhesive tape is adhered thereto and then abruptly peeled off, there was found no problem with respect to the adhesion between the support and the light sensitive layer. However, it was found that when being cut to a given product standard size with high shearing force such as a guillotine, peeling of the light sensitive layer was caused. In view of the foregoing, adhesion properties were tested according to the following procedure, instead of the above-described peeling test.

Thus, a photothermographic material is cut to a test sample of a size of 20 mm wide and 110 mm long. The thus cut sample is set in a Tensilon type tensile testing machine under a temperature of −20° C. by chucking 30 mm of the upper and lower sides and pulled to a factor of 1.3 to 1.5 at a speed of 10 mm/min. Subsequently, the sample is taken out and allowed to stand for 30 min. at a low temperature, then, placed in to an atmosphere at 23° C. and 55% RH, and further allowed to stand for 3 hr. without causing condensation. Using an adhesive tape, double-coated on a PET substrate (TERAOKA TAPE), two sheets of the sample are laminated for half its length on the light sensitive layer-side portion. Each of the non-laminated half portions is chucked and subjected to the tensile testing at a speed of 10 mm/min. As a result, it was proved that if no break rupture at a load of 1 N/20 mm, adhesion in cutting is superior.

However, this method is rather lengthy time consuming and so complex that instead thereof, a simplified testing method was employed. Thus, the sample is similarly pulled at −20° C. and the relationship between the above-mentioned test and this test was determined. As a result, adhesion strength can be represented by the elongation (%) at rupture of the light sensitive layer. This method is further described in Examples. Various phenomena caused by a high shearing force at the time of cutting can be clearly discriminated by elongating a photothermographic material to an extent of 30 to 50% by a tensile testing machine, resulting in rupture of the light sensitive layer.

EXAMPLES

Embodiments of the present invention will be further described on examples but the invention are by no means limited to these.

Example 1

Sample Preparation

Surface Treatment of Support

Using the apparatus shown in FIG. 1 under conditions described below, the treatment chamber was purged for 10 min. with introducing gas thereto, then, the treatment started while a support film was transported and after 2 min. after reached stable transport, the treated support was measured with respect to the following surface properties. Further, the treated support film was reeled on a roll using a reeling apparatus and subjected to coating of a photothermographic layer sensitive layer.

Treatment Condition

Treatment chamber: volume of 0.2 $m^3$, width of 420 mm;

Support: 400 mm wide, 100 $\mu$m thick;

Treatment gas: inert gas of 100% by pressure argon gas was introduced; the ratio of inert gas to reactive gas was varied within the range of Ar: reactive gas=100:1 to 100:100, methane, ethane, propane and methyl fluoride was used as a reactive gas, and $N_2$ gas was used as comparative reactive gas (as shown in Table 1);

Frequency: 10 kHz;

Gap between electrodes: 5 mm;

Support transporting speed: 150 m/min;

Treatment time: 0.5 sec

Output: 22 kW/$m^2$.

The treatment chamber was purged for 10 min. with introducing gas thereto and after 2 min. after reached stable transport, the oxygen concentration was measured with respect to the following surface properties, using a commercially available instrument for measuring oxygen concentration (LC800, available Toray Co;, Ltd.). As a result, the oxygen concentration was 100 ppm.

Measurement and Evaluation of Support Surface Property

Measurement of Contact Angle

Methylene iodide (specifically high grade reagent) and pure water were used as liquid for measuring the contact angle. In a clean room maintained at 23° C. and 55% RH, a drop of the liquid was put on the support surface and the contact angle was measured at 3 sec after being dropped by a contact angle measuring instrument (available from FIBLO Corp.).

Spectrometry of TOF-SIMS

Support samples were measured within 1 hr. (allowed to stand in an atmosphere of 23° C. and 55% RH) after subjected to the surface treatment using a TOF-SIMS measurement apparatus (TRIFTII, available from PHI Corp.), capable of measuring functional groups and molecular weight distribution.

Measurement of Carbon Atom Proportion by ESCA

Support samples were measured within 1 hr. (allowed to stand in an atmosphere of 23° C. and 55% RH) after subjected to the surface treatment using a ESCA measurement apparatus (ESCALAB 200-R, available from VG Corp.), capable of measuring surface element composition of the support.

Preparation of Silver Halide Emulsion A

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide (in a molar ratio of 98 to 2) $1\times10^{-6}$ mol/mol Ag of Ir(NO) $Cl_5$ and $1\times10^{-4}$ mol/mol Ag of rhodium chloride were added by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 μm, a variation coefficient of the projection area equivalent diameter of 8 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively, to obtain silver halide emulsion. The thus obtained emulsion was chemically sensitized with chloroauric acid and sulfur (simple substance) to obtain silver halide emulsion A.

Preparation of Sodium Behenate Solution

In 945 ml water were dissolved 32.4 g of behenic acid, 9.9 g of arachidic acid and 5.6 g of stearic acid at 90° C. Then, after adding 98 ml of 1.5M aqueous sodium hydroxide solution with stirring and further adding 0.93 ml of concentrated nitric acid, the solution was cooled to a temperature of 55° C. to obtain an aqueous behenic acid sodium salt solution.

Preparation of Pre-formed Emulsion

To the obtained sodium behenate solution were added 15.1 g of silver halide emulsion A and the pH was adjusted to 8.1 with sodium hydroxide. Subsequently, 147 ml of 1M aqueous silver nitrate solution was added in 7 min. and stirring continued further for 20 min., then, the reaction mixture was subjected to ultrafiltration to remove aqueous soluble salts. The resulting silver behenate was comprised of particles exhibiting an average size of 0.8 μm and a degree of monodispersity of 8%. After forming flock of dispersion, water was removed, then, washing and removal of water were repeated six times and dried to a pre-formed emulsion.

Preparation of Light Sensitive Silver Halide Emulsion B

To the pre-formed emulsion obtained above, 544 g of a 17% by weight methyl ethyl ketone solution of polyvinyl butyral having a weight-average molecular weight of 60,000 and polyvinyl butyral having a weight-average molecular weight of 10,000 (in a ratio by weight of 75/25) and 107 g of toluene were gradually added and then dispersed under pressure of 1.9 Pa.

Coating of Backing Layer (d-1)

On the support which was subjected to the surface treatment for enhancing hydrophobicity, the backing layer coating solution (d-1) having the following composition was coated and dried at 60° C. for 15 min. to form backing layer (d-1):

| | |
|---|---|
| Cellulose diacetate (10 wt % methyl ethyl ketone solution) | 150 ml |
| Surfactant A-13, described in JP-A No. 9-73153 | 0.6 g |
| Fine silica particles (av. size of 2 μm) | 3 g |

Coating of Backing Protective Layer

On the backing layer (d-1), the backing layer coating solution (d-2) having the following composition was coated and dried at 60° C. for 15 min. to form backing layer (d-2):

| | |
|---|---|
| Cellulose diacetate (10 wt % methyl ethyl ketone solution) | 15 ml/m$^2$ |
| Dye-B | 7 mg/m$^2$ |
| Dye-C | 7 mg/m$^2$ |
| Matting agent (monodisperse silica exhibiting monodispersity degree of 15% and average particle size of 10 μm) | 30 mg/m$^2$ |
| $C_8H_{17}C_6H_4SO_3Na$ | 10 mg/m$^2$. |

-B

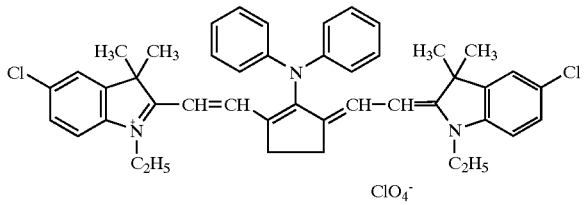

-C

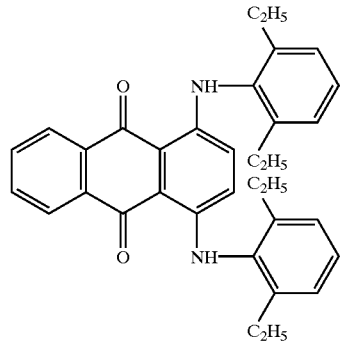

Coating of Light Sensitive Silver Halide Emulsion Layer C

| | |
|---|---|
| Light sensitive silver halide emulsion B | 240 g/m$^2$ |
| Sensitizing dye-1 (0.1 wt % methanol solution) | 1.7 ml |
| Pydinium bromide perbromide (6% methanol solution) | 3 ml |
| Calcium bromide | 1.7 ml |

-continued

| | |
|---|---|
| (0.1 wt % methanol solution) | |
| Antifoggant-1 | 1.2 ml |
| (10 wt % methanol solution) | |
| 2-4-chlorobenzoylbenzoic acid | 9.2 ml |
| (12 wt % methanol solution) | |
| 2-Mercaptobinzimidazole | 11 ml |
| (1 wt % methanol solution) | |
| Tribromomethylsulfoquinoline | 29.5 ml |
| (20 wt % methanol solution) | |

To this emulsion, fluorinated surfactant F-10 was added in an amount of 20 mg/m$^2$ to a photothermographic silver halide light sensitive layer C.

-1

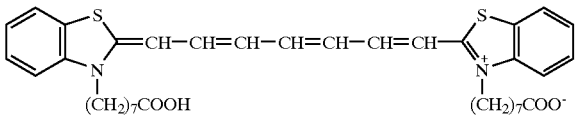

-2

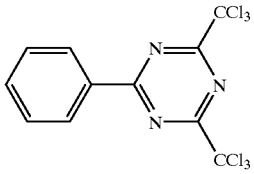

The following coating composition was coated on the silver halide photothermographic emulsion layer.

| | |
|---|---|
| Cellulose diacetate | 2.3 g/m$^2$ |
| Methanol | 7 ml/m$^2$ |
| Phthalazine | 250 mg/m$^2$ |
| 4-Methylphthalic acid | 180 mg/m$^2$ |
| Tetrachlorophthalic acid | 150 mg/m$^2$ |
| Tetrachlorophthalic acid anhydride | 170 mg/m$^2$ |
| Matting agent, monodisperse silica Having av. size of 4 $\mu$m and a degree of monodispersity of 10% | 70 mg/m$^2$ |
| $C_8H_{17}$—$C_6H_4SO_3Na$ | 10 mg/m$^2$ |

Thermal Processing

The thus prepared silver halide photothermographic material samples were each thermally processed by bringing the light sensitive layer into contact with a heated drum (110° C., 15 sec.) in an automatic thermal processor. The thermal processing was conducted in a room maintained at 23° C. and 50% RH.

Tape Adhesion Test

Unprocessed and processed samples were each cut to a size of 200 mm long and 100 mm wide and allowed to stand in a room maintained at 23° C. and 55% RH for 24 hrs. Each sample was placed on a platform and its surface was cut deeply at an angle of 45° for a length of 50 mm with a single-edged razor. A 60 mm long and 25.4 mm wide cellophane adhesive tape (NICHIBAN Cellotape CT405A-24, available from NICHIBAN Co., Ltd.) was adhered vertically and across the cut so as to be a length of 20 mm in the direction opposite to the cutting angle of 45° and the surface thereof was rubbed with a rounded plastic resin to allow the cellophane tape to be adhered to the sample. Grasping the non-adhered portion of the tape (the portion cut at 45°) by a hand, the cellophane tape was abruptly and horizontally pulled in the direction opposite to the cutting angle of 45°. The extent of peeling of the light sensitive layer adhered to the 20 mm cellophane tape was evaluated based on the following criteria:

A: no peeling occurred,

B: peeling of less than 5% near the cut portion

C: peeled portion of not less than 5% and less than 10%,

D: peeled portion of not less than 10% and less than 50%,

E: peeled portion of not less than 50% and less than 100%,

F: peeling of more than the adhered area.

Tensile Test at Low Temperature

Photothermographic material samples were each cut to a size of 110 mm long and 20 mm wide and allowed to stand in a room maintained at −20° C. for 10 hrs. Each sample was set in a Tensilon-type tensile testing machine (RTC-1210, available from Orientic Co., Ltd.) under identical conditions by chucking 100 mm of the upper and lower end, pulled to an elongation to 150%, and the elongation (%) at rupture of the light sensitive layer was read. In the case of an non-ruptured sample, the light sensitive layer surface was observed with a 20 power magnifier with respect to cracking. Each sample was evaluated with respect to the elongation at rupture of the light sensitive layer, and the state of rupture or cracking, based on the following criteria:

A: neither rupture nor cracking occurred in the light sensitive layer even when elongated to 150%, B: no rupture occurred when elongated to 150% but slight minute cracking occurred, C: rupture occurred at elongation of 140 to 150%, D: rupture occurred at elongation of not less than 130% and less than 140%, E: break occurred at an elongation of not less than 120% and less than 130%, F: break occurred at an elongation of less than 120%.

Cutting Test by Guillotine Cutter

Photothermographic material samples were each cut to A4-size sheets, 100 sheets of each were superposed and cut by a guillotine cutter. The section and the cut end were observed with a 20 power magnifier whether the light sensitive layer separated from the support or not and whether cracking occurred at the end of the light sensitive layer. Each sample was evaluated based on the following criteria:

A: no separation nor cracking of the layer occurred,

B: no separation but slight minute cracking of the layer was observed,

C: separation and cracking of the layer occurred,

D: separation of the layer occurred and when peeled, peeling occurred at both ends, E: marked separation of the layer occurred and when peeled, peeling occurred to 10 mm from the end, F: peeling of the layer occurred and when peeled, marked peeling occurred from the end to the center.

In Table 1 are shown the treatment condition of the support, measured values of the contact angle, variation of a spectrum peak of TOF-SIMS, and an increase of the proportion of carbon atoms, measured by ESCA. In Table 2, test results of the photothermographic material samples are shown with respect to tape adhesion test of unprocessed and processed samples, tensile tests at a low temperature and cutting tests.

TABLE 1

| Sample No. | Reactive Gas | Inert Gas: Reactive Gas (by pressure) | Contact Angle (°) Water | Contact Angle (°) Methylene Iodide | Variation in TOF-SIMS | Increase of Carbon Atom Proportion (%) | Remark |
|---|---|---|---|---|---|---|---|
| 1 | Methane | 100:1 | 66 | 22 | 15 | 0.8 | Inv. |
| 2 | Methane | 100:3 | 67 | 23 | 20 | 1.0 | Inv. |
| 3 | Methane | 100:10 | 68 | 24 | 25 | 1.2 | Inv. |
| 4 | Ethane | 100:10 | 72 | 26 | 30 | 1.8 | Inv. |
| 5 | Propane | 100:10 | 80 | 30 | 40 | 2.5 | Inv. |
| 6 | $CH_3F$ | 100:10 | 86 | 35 | 46 | 2.8 | Inv. |
| 7 | — | 100:0 | 50 | 20 | 3 | 0.4 | Comp. |
| 8 | $N_2$ | 100:10 | 20 | 20 | 5 | 0.1 | Comp. |
| 9 | Non-treated support | | 63 | 18 | 0 | 0.0 | Comp. |

TABLE 2

| Sample No. | Tape Adhesion Test: Before Processing | Tape Adhesion Test: After Processing | Tensile Test | Cutting Test | Remark |
|---|---|---|---|---|---|
| 1 | A | B | C | B | Inv. |
| 2 | A | B | B | B | Inv. |
| 3 | A | A | A | A | Inv. |
| 4 | A | A | A | A | Inv. |
| 5 | A | A | A | A | Inv. |
| 6 | A | A | A | A | Inv. |
| 7 | B | E | E | E | Comp. |
| 8 | B | E | F | F | Comp. |
| 9 | B | B | E | E | Comp. |

As can be seen from Table 1, the supports which were subjected to the surface treatment exhibited a larger contact angle, a larger variation of the spectrum peak in TOF-SIMS and a larger variation in carbon atom proportion, measured by ESCA, compared to untreated one, indicating enhancement in hydrophobicity of the support surface. Sample 8 in which $N_2$ gas was employed as reactive gas and Sample 7 in which no reactive gas was employed exhibited a smaller contact angle, compared to Sample 9, in which a non-treated support was employed. It is specifically noted that Sample 8 indicated the hydrophilicity-enhanced surface from the result of a contact angle with respect to water. As can be seen From Table 2, with respect to adhesion property of the light sensitive layers formed using these supports, samples having hydrophobicity-enhanced surface which was subjected to the surface treatment of this invention superior results in the tensile test at a low temperature and the cutting test. With regard to the tape adhesion test, no remarkable difference between untreated or $N_2$-treated sample and samples subjected to the surface treatment for enhancing hydrophobicity was observed. On the contrary, marked differences were observed in the low temperature tensile test and the cutting test, indicating advantageous effects of this invention. In view of the fact that even when a silver halide photothermographic material coated on an untreated support exhibited acceptable results in adhesion property (i.e., tape adhesion test), peeling occurred at the time of cutting with a cutter, according to this invention, a new test method was developed, the surface treatment method of a support whereby no peeling occurred even at the time of cutting, and whereby a support and a photothermographic silver halide material were obtained.

What is claimed is:

1. A surface treatment method for enhancing hydrophobicity of a surface of a film support, the method comprising subjecting at least one side of the surface of said film support to a gas-discharge plasma treatment in a gas phase atmosphere comprising (a) an insert gas comprising argon or helium and (b) a reactive gas comprising a hydrocarbon gas or fluorinated hydrocarbon gas, and wherein the gas phase atmosphere contains not more than 750 ppm of oxygen.

2. The method of claim 1, wherein the oxygen is not more than 600 ppm.

3. The method of claim 2, wherein the oxygen is not more than 200 ppm.

4. A surface treatment method for enhancing hydrophobicity of a surface of a film support, the method comprising subjecting at least one side of the surface of said film support to a gas-discharge plasma treatment in a gas phase atmosphere comprising (a) an inert gas comprising argon or helium and (b) a reactive gas comprising a hydrocarbon gas or fluorinated hydrocarbon gas, and wherein the hydrocarbon is at least one of the group consisting of a saturated hydrocarbon represented by formula $C_nH_{2n+2}$ and unsaturated hydrocarbon represented by formula $C_nH_{2n}$ or $C_nH_{2n-2}$, in which n is an integer of 1 to 12.

5. A surface treatment method for enhancing hydrophobicity of a surface of a film support, the method comprising subjecting at least one side of the surface of said film support to a gas-discharge plasma treatment in a gas phase atmosphere comprising (a) an inert gas comprising argon or helium and (b) a reactive gas comprising a hydrocarbon gas or fluorinated hydrocarbon gas, and wherein the fluorinated hydrocarbon is at least one of the group consisting of $CH_3F$, $C_2H_5F$, $C_3H_7F$, $C_4H_9F$, $C_5H_{11}F$, and $C_6H_{13}F$.

6. A method for forming a silver halide photothermographic material having at least an image forming layer on a film support comprising the steps of:

(i) subjecting at least one side of a surface of the film support to a gas-discharge plasma treatment in a gas phase atmosphere comprising (a) an inert gas comprising argon or helium and (b) a reactive gas comprising a hydrocarbon gas or fluorinated hydrocarbon gas and (ii) coating at least said image forming therein a layer on the side subjected to the gas-discharge plasma treatment.

7. The method of claim 6, wherein the inert gas is accounted for by argon of not less than 50% by pressure or by helium of less than 40% by pressure.

8. The method of claim 6, wherein the inert gas comprises argon.

9. The method of claim 6, wherein the gas phase atmosphere is in the vicinity of atmospheric pressure.

10. The method of claim 6, wherein the film support is subjected to the plasma treatment, while the film support is continuously transported.

11. The method of claim 6, wherein the gas phase atmosphere contains not more than 750 ppm of oxygen.

12. The method of claim 11, wherein the oxygen is not more than 600 ppm.

13. The method of claim 12, wherein the oxygen is not more than 200 ppm.

14. The method of claim 6, wherein the hydrocarbon is at least one of the group consisting of a saturated hydrocarbon represented by formula $C_nH_{2n+2}$ and unsaturated hydrocarbon represented by formula $C_nH_2n$ or $C_nH_{2n-2}$, in which n is an integer of 1 to 12.

15. The method of claim 6, wherein the fluorinated hydrocarbon is at least one of the group consisting of $CH_3F$, $C_2H_5F$, $C_3H_7F$, $C_4H_9F$, $C_5H_{11}F$, and $C_6H_{13}F$.

* * * * *